US006183400B1

(12) United States Patent
Pope

(10) Patent No.: US 6,183,400 B1
(45) Date of Patent: Feb. 6, 2001

(54) HAND AT REST GRIP

(76) Inventor: Harold Raymond Pope, R.D. 2, Box 4660, Felton, PA (US) 17322

( * ) Notice: Under 35 U.S.C. 154(b), the term of this patent shall be extended for 0 days.

(21) Appl. No.: 09/344,984

(22) Filed: Jun. 25, 1999

(51) Int. Cl.[7] ..... A63B 21/072

(52) U.S. Cl. ..... 482/92; 482/108; 482/139; 16/422; 16/430; 74/551.8; 74/551.9

(58) Field of Search ..... 482/49, 50, 92, 482/93, 106, 108, 139; 74/551.8, 551.9; 16/422, 430; D21/682

(56) References Cited

U.S. PATENT DOCUMENTS 1,263,508 * 4/1918 Zeckser ..... 16/422
4,487,412 * 12/1984 Meeko ..... 482/106
5,009,416 * 4/1991 Caruthers ..... 482/108
5,135,455 * 8/1992 King et al. ..... 482/108
5,342,268 * 8/1994 Caruthers ..... 482/108
5,626,780 * 5/1997 Ogata ..... 74/551.9
5,761,767 * 6/1998 Barton ..... 16/430

* cited by examiner

*Primary Examiner*—John Mulcahy

(57) ABSTRACT

An attachment or accessory for exercise devices such as barbells, dumbbells, weight training machines or any device utilizing a cylindrical bar. The accessory or attachment is intended for strengthening a user's targeted muscle without the necessity of a forceful grip and provides a safer, more effective, and efficient workout. The device is made up of two parts, which are hinged together, to form a grasping area of 16 square inches as opposed to 4 square inches on a regular one inch diameter bar. The unit is secured to the bar with a latch. There is a palm heel to prevent the unit from rotating and to help keep the shaft approximately 90 degrees to the hand. The strap uniformly spreads the weight of the exercise device over the back of the hand reducing the need of forceful grip for lifting the weights when the hand is over the weight.

13 Claims, 9 Drawing Sheets

1. Finger Half
2. Hinge pin
3. Pads
4. Latch
5. Palm Heel
6. Finger Grooves
7. Strap
9. Palm Half
10. Thumb surface area

SECTION A-A

SECTION B-B FIG 12

HAND AT REST GRIP

REFERENCES CITED

| U.S. PATENT DOCUMENTS | | | |
|---|---|---|---|
| 4,487,412 | 12/1984 | Meeko | 272/123 |
| 5,009,416 | 4/1991 | Caruthers | 272/143 |
| 5,342,268 | 8/1994 | Caruthers | 482/108 |

FIELD OF THE INVENTION

A method and apparatus for increasing the effectiveness of weight training and strength training, as well as in the rehabilitation and therapy environment by allowing the user to more effectively focus an exercise on the targeted muscle.

BACKGROUND OF INVENTION

The use of weight training and strength training equipment for strengthening muscles is well known. Through the years, inventors of these devices have continually sought improved methods for isolating a targeted muscle to provide increased effectiveness to the user for each exercise repetition. An ongoing problem in this area of development is the fact that almost any exercise of the biceps, triceps, or deltoids requires a gripping and grasping action that further involves the conjunctive muscles of the arm. The blood flow is restricted, the blood pressure rises and the muscles fatigue more rapidly. As part of an ongoing study on the subject, Dr. Banks from Howard University has stated that the cumulative effect of this gripping action is to reduce the effectiveness of the exercise by approximately 30%.

U.S. Pat. No. 5,009,416 to Caruthers disclosed a grip facilitating handle which can be attached to the handle of an exercise device to allow the user to manipulate or control the device without the necessity of a forceful grip. This handle grip, however, requires the use of a cumbersome C-clamp, which must be added to the base invention, to prevent the handle of the exercise device from rotating in the grip facilitating handle device. This handle grip also requires the user's thumb to rest on the same side as the fingers. The subject invention differs from this prior art by: (1) by eliminating the need for a dual wall grip, thus reducing manufacturing costs and making one size fit all user hands; (2) allowing the user to grip the handle more naturally, with the thumb opposed to the fingers; (3) the use of strategically placed rubber pads to eliminate the rotation of the handle of the exercise device within the grip; and (4) allowing the user to easily remove the grip and reattach it to handles of other exercise devices with various diameters.

U.S. Pat. No. 4,487,412 to Meeko disclosed a weight lifting grip to increase the user's gripping power and weight training level on weight training equipment. This device, however, uses a U-shaped cradle to hold the handle of the exercise device, which allows the handle of the exercise device to rotate in the grip. This device also requires the user's thumb to rest on the same side as the fingers. The subject invention differs from this prior art by: (1) allowing the use of a relaxed natural gripping position, with the thumb opposing the fingers, around a grip that is contoured to closely match the natural contours of the hand; (2) the use of strategically placed rubber pads to eliminate the rotation of the handle of the exercise device within the grip; and (3) allowing the user to easily remove the grip and reattach it to handles of other exercise devices with various diameters.

U.S. Pat. No. 5,342,268 to Caruthers disclosed an exercise device intended for strengthening a user's target muscle, wherein the user may manipulate the device without the necessity of a forceful grip that employs the user's conjunctive muscles. However, this exercise device is a self contained and can not be used to modify any other exercise device which requires a forceful grip. Also this device requires the user's thumb to rest on the same side as the fingers. The subject invention differs from this prior art by: (1) being an accessory or grip to be used with the user's existing exercise devices; and (2) allowing the user's to use a more natural grip with the thumb opposed to the fingers.

SUMMARY OF INVENTION

Accordingly, it is an object of the present invention to alleviate the deficiencies and disadvantages of the prior art and to provide a safer, more efficient and effective workout. The Hand at Rest Device does this by providing a grip to be used on an exercising device, possessing a bar or shaft type handle, wherein the user's hand is substantially in a relaxed natural gripping position, with the thumb opposing the fingers, around a grip that is contoured to closely match the natural contours of the hand, rather than being tightly closed around the handle, such that a forceful grip is not required to control the exercise device to which it is attached. Thus the use of the present invention increases the blood flow to the targeted muscles; decreases the fatigue of the targeted muscles, and decreases blood pressure, providing a safer and more effective workout for the user.

It is another object of the present invention to provide a grip with an adjustable and removable strap, which in up to 53% of all upper body exercise positions distributes the weight of the exercise device over the back of the user's hand, thus allowing the user to utilize a relaxed grip. The adjustable strap also provides additional safety and support to the user.

It is another object of the present invention to provide a grip that can be used on various size diameter bar handles of exercising devices so that the user can easily use the same grip on many different pieces of exercise equipment. The enclosed embodiment shows a grip that fits bar handles that are 1"1⅛" and 1¼" in diameter, however the invention is not intended to be limited to these three diameter handles, nor is it intended to be limited to a grip that fits only three different diameters. The invention includes a grip with a single latch or any type of multiple latch that will fit over a bar or shaft type handle ranging from ⅛" diameter to 3" diameter.

It is another object of the present invention to provide a grip to be used on an exercising device, possessing a bar type handle, that will not rotate about the axis of the bar handle of the exercise device to which it is attached. The Hand at Rest Device does this by the use of rubber pads that are fit into grooves at strategically positioned locations, such that the device will grip the various diameter shafts, thus eliminating the inefficiencies in exercising with a grip that is free to slip around the axis of the bar handle of the exercise device to which it is attached.

It is another object of the present invention to provide a grip that can be attached and removed from the bar handle of an exercising device quickly and efficiently; so that the user can easily use the same grip on many different pieces of exercise equipment.

DETAILED DESCRIPTION OF INVENTION

Figure 1:
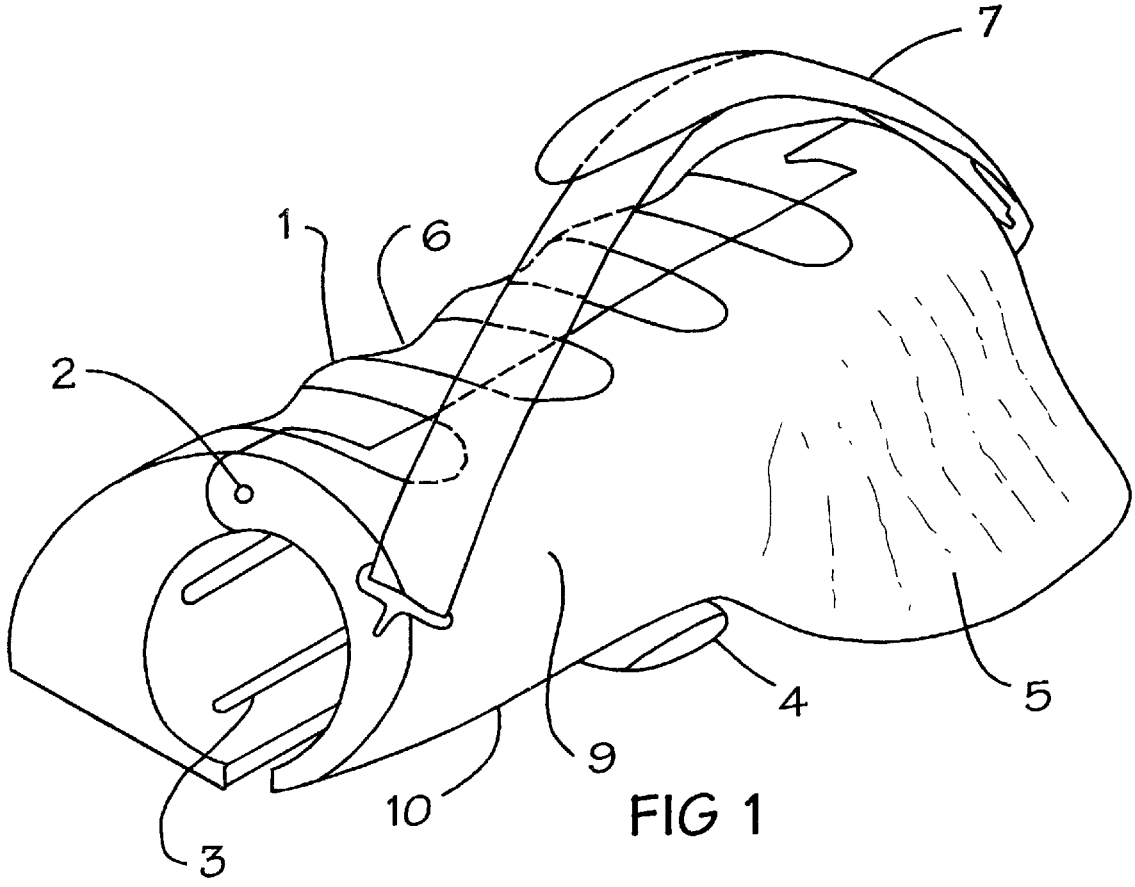
FIG. 1 shows a three-dimensional view for the Hand at Rest Device for bars, handles, and shafts.

FIG. 1 shows a three dimensional view of the Hand at Rest Device for bars, handles and shafts. Hinge pin 2 connects the finger half 1 to the palm half 9 and allows the assembly to fit over the shaft. Rubber pads 3 are strategically positioned such that the device will grip the various diameter shafts. Three position latch 4 is adjustable to fit 1", 1⅛" and 1 ¼" diameter shafts. Palm heel 5 prevents the Hand at Rest Device from rotating in the hand and helps to keep the shaft approximately 90 degrees to the hand. Finger grooves 6 are used to help stabilize the Hand at Rest Device in the hand. Adjustable and removable strap 7 is required for 53% of all upper body exercise positions to distribute the weight of the exercise device over the back of the user's hand. Adjustable strap 7 also provides safety and support while in use and may be used on the foot for leg extensions. Palm half 9 is contoured to fit the palm of the hand, while thumb surface area 10 allows the thumb to grasp the device opposite the fingers, resulting in a more efficient grip.

Figure 2:
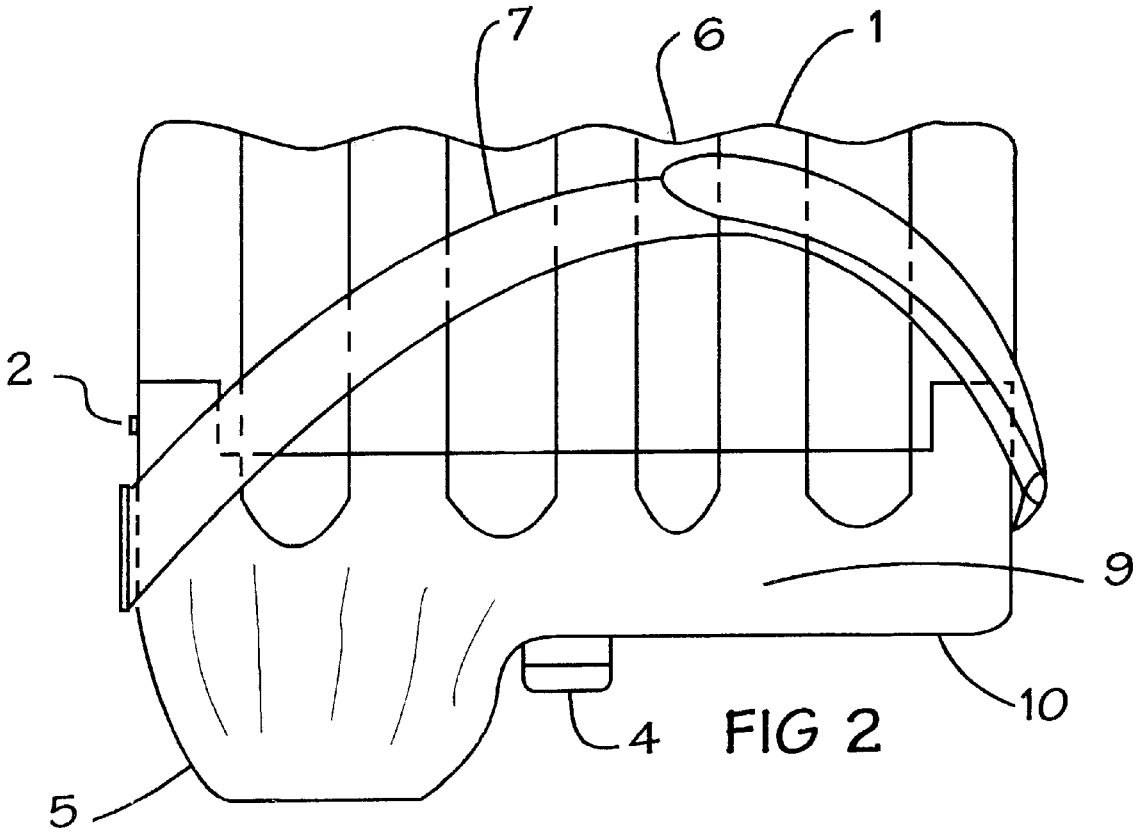
FIG. 2 shows the plane view for the Hand at Rest Device for bars, handles, and shafts.
Figure 3:
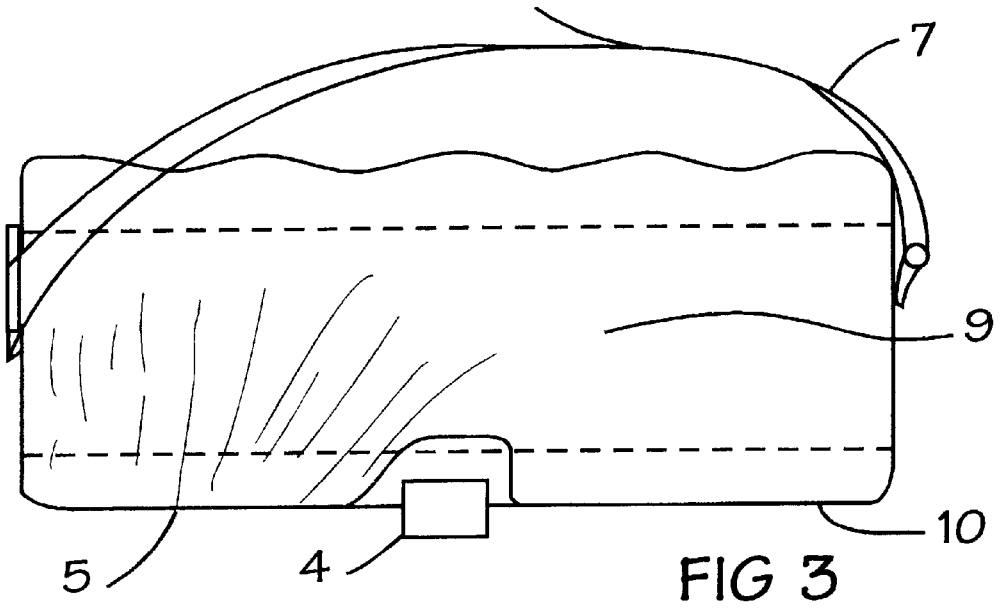
FIG. 3 shows the side view for the Hand at Rest Device for bars, handles, and shafts.
Figure 4:
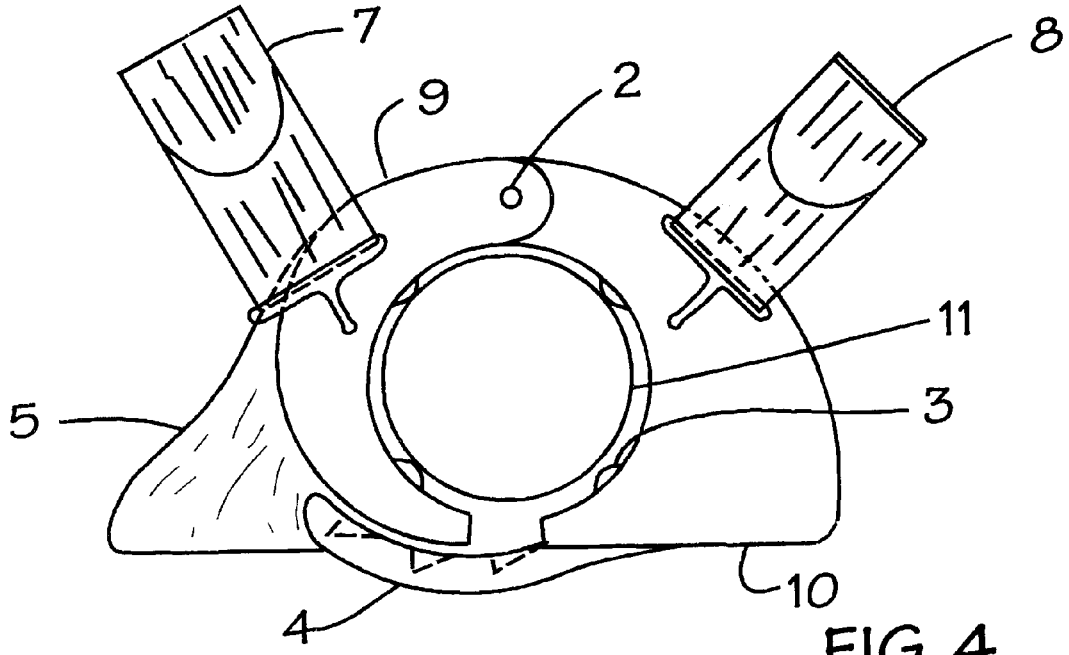
FIG. 4 shows the end view for the Hand at Rest Device for bars, handles, and shafts, with 1 ⅛" diameter.

FIG. 2, the plane view, FIG. 3, the side view facing the palm heel 5, and FIG. 4, the end view, together show the following features: hinge pin 2 connects the finger half 1 to the palm half 9 and allows the assembly to fit over the shaft; rubber pads 3 grip the various size shafts; the three position latch is adjustable to fit 1", 1⅛" and 1 ¼" diameter shafts; the palm heel 5 prevents the Hand at Rest Device from rotating in the hand and helps to keep the shaft approximately 90 degrees to the hand; finger grooves 6 provides more comfort for holding and are used to help stabilize the Hand at Rest Device in the hand; adjustable and removable strap 7 is required for 53% of all upper body exercise positions to distribute the weight of the exercise device over the back of the user's hand; adjustable strap 7 also provides safety and support while in use and may be used on the foot for leg extensions; optional strap 8 may be used by handicapped users or those needing more support; and thumb surface area 10 allows the thumb to grasp the device opposite the fingers, resulting in a more efficient grip.

FIG. 4 shows the end view of the Hand at Rest Device on a 1 ⅛" diameter shaft 11.

Figure 5:
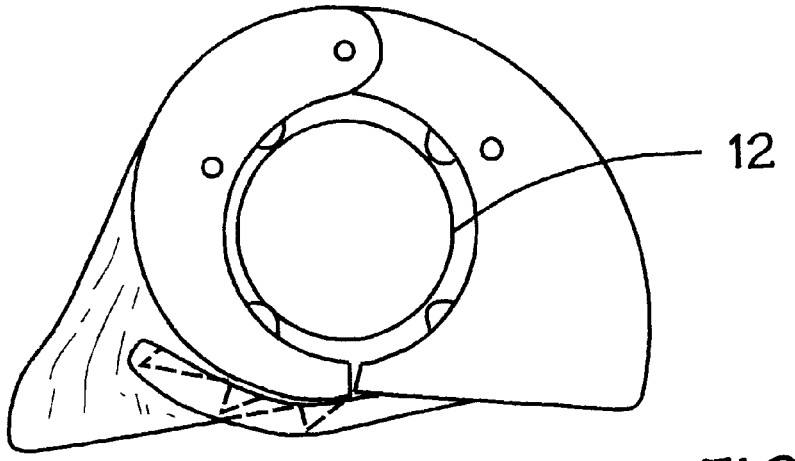
FIG. 5 shows the end view for the Hand at Rest Device for bars, handles, and shafts, with 1" diameter.

FIG. 5 shows the end view of the Hand at Rest Device on a 1" diameter shaft 12.

Figure 6:
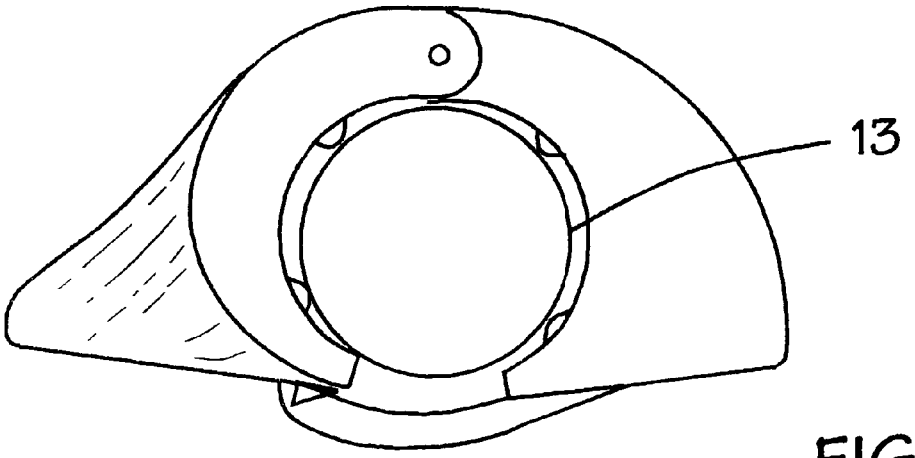
FIG. 6 Shows the end view for the Hand at Rest Device for bars, handles, and shafts, with 1 ¼" diameter.

FIG. 6 shows the end view of the Hand at Rest Device on a 1 ¼ " diameter shaft 13.

Figure 7:
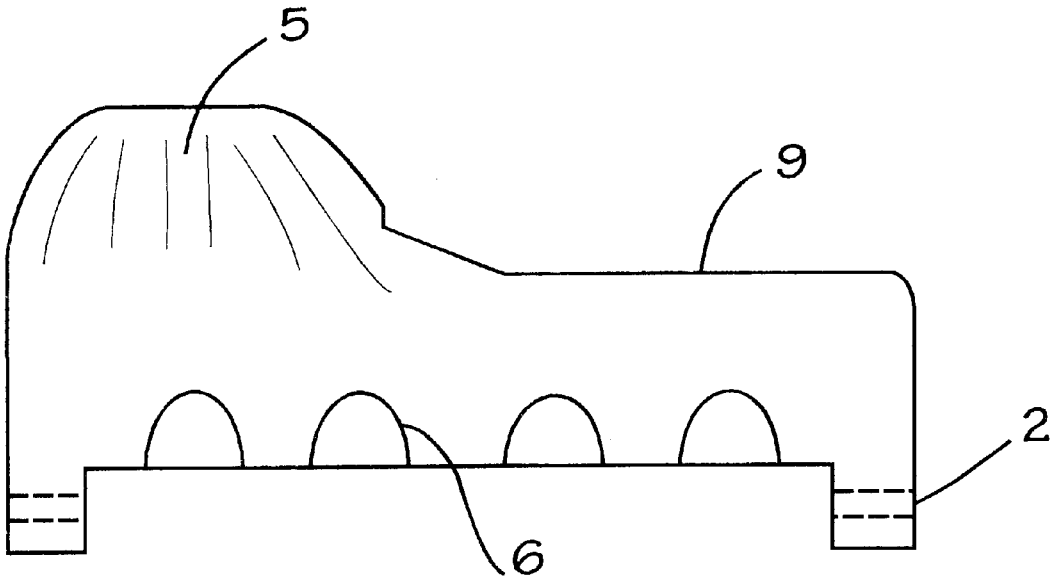
FIGS. 7, 8 and 9 show the three views for the palm half, 9 in more detail.
Figure 8:
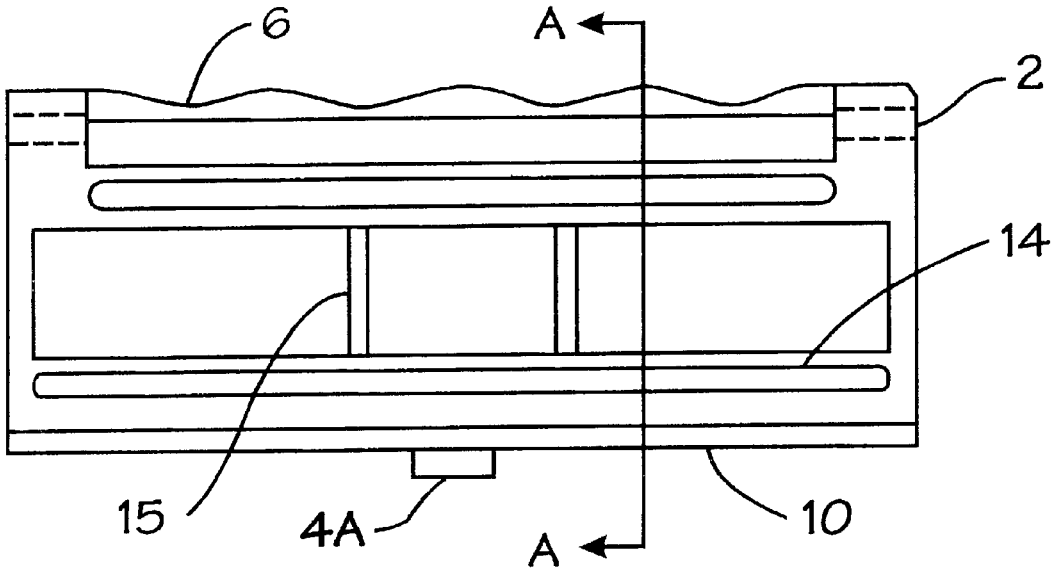
Figure 9:
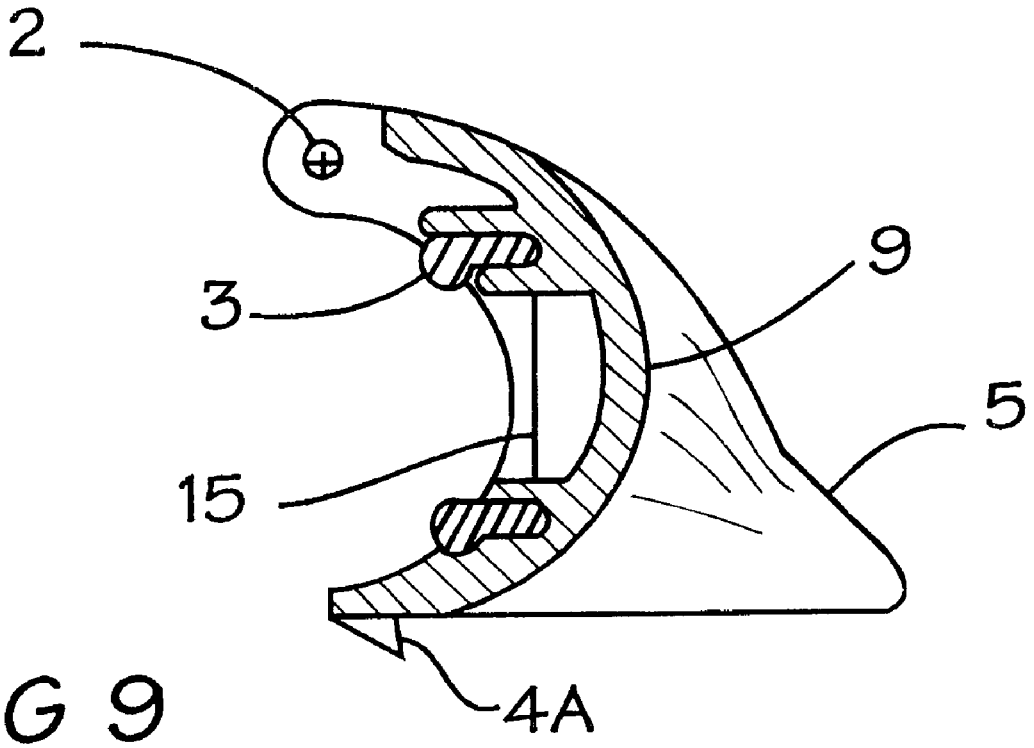
Figure 12:
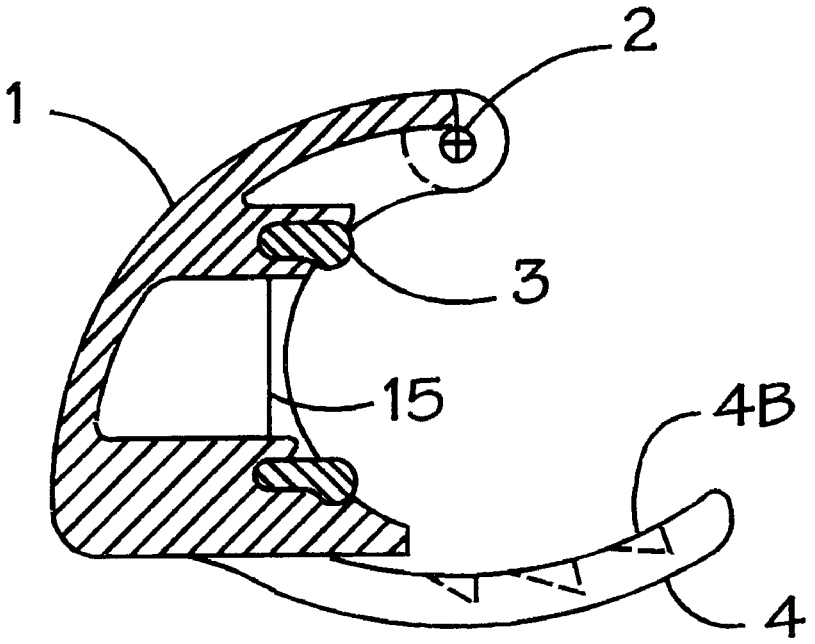

FIG. 7, plane view of palm half 9, FIG. 8, side view showing interior of palm half 9, and FIG. 9, end view of palm half 9, together show the following features: hinge pin 2 connects the finger half 1 to the palm half 9 and allows the assembly to fit over various diameter shafts; rubber pads 3 fit into grooves 14 to grip the various diameter shafts; latch hook 4A snaps into notches 4B in latch 4, shown in more detail in FIG. 12, to secure the Hand at Rest Device unto the shaft; palm heel 5 prevents the Hand at Rest Device from rotating in the hand while in use and keeps the shaft 90 degrees to the hand; finger grooves 6 provides more comfort for holding and helps to stabilize the Hand at Rest Device in the hand; palm half 9 fits the palm of the hand while in use; thumb surface area 10 allows the thumb to grasp the device opposite the fingers, resulting in a more efficient grip; rubber pad grooves 14 support the rubber pads 3; ribs 15 provide added strength.

Figure 10:
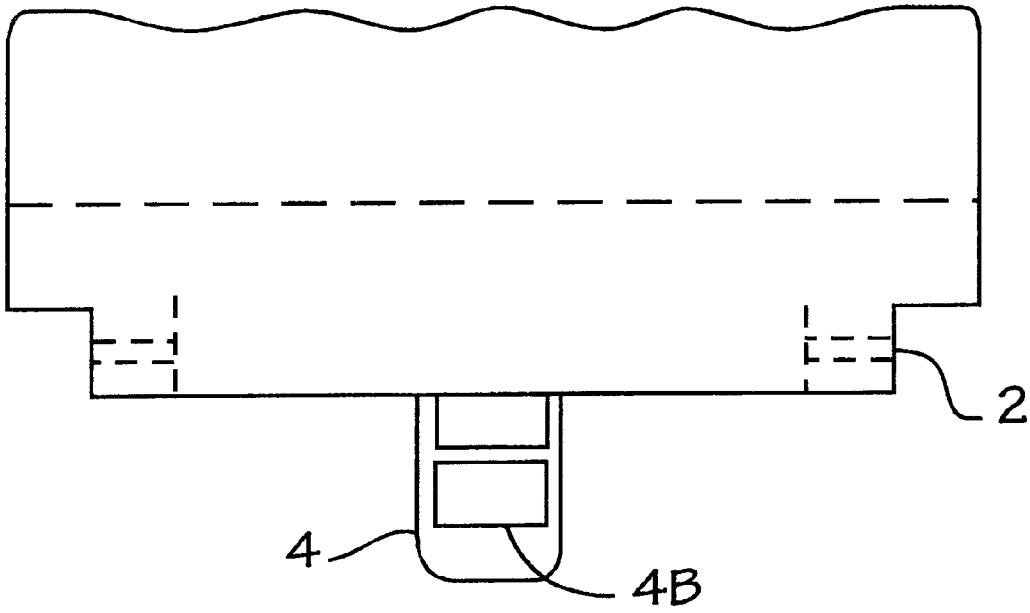
FIG. 10, 11 and 12 show the three views for the finger half 1 in more detail.

FIG. 10, plane view of finger half 1.

Figure 11:
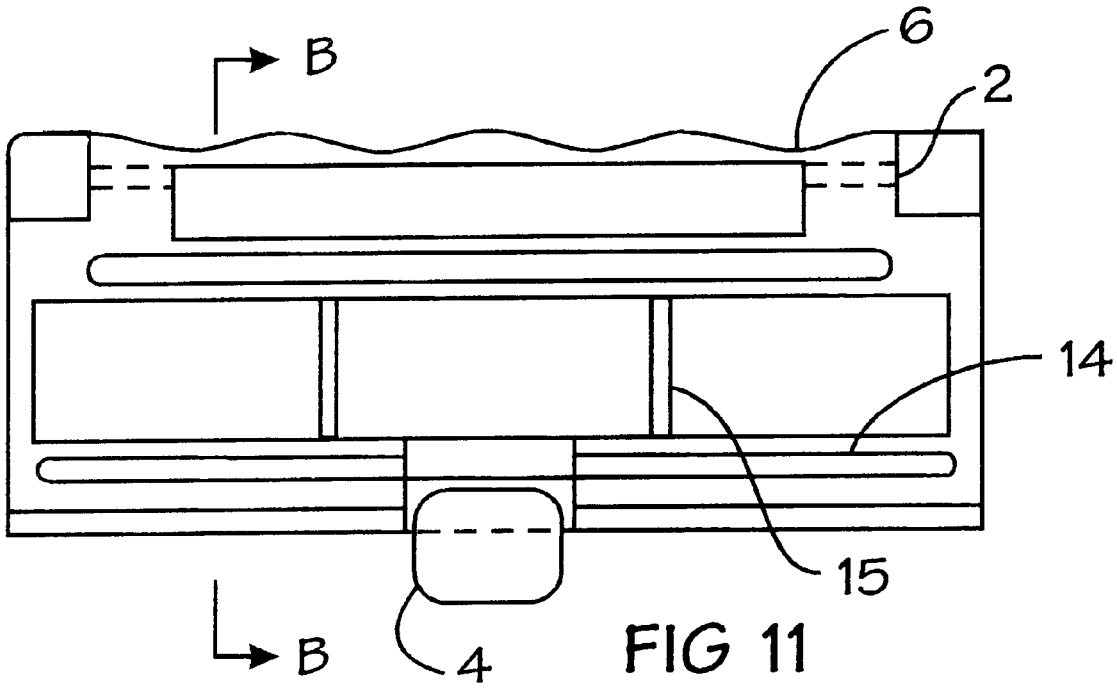

FIG. 11, side view of finger half 1, showing interior of Hand at Rest Device.

FIG. 12, end view of finger half 1, shows the following features: hinge pin 2 connects the finger half 1 to the palm half 9 and allows the assembly to fit over various diameter shafts; rubber pads 3 fit into grooves 14 to grip the various diameter shafts; three-position latch 4 secures the Hand at Rest Device using latch notches 4B; finger grooves 6 provides more comfort for holding and helps to stabilize the Hand at Rest Device in the hand; rubber grooves 14 support rubber pads 3; ribs 15 provide more strength; and thumb surface area 10 allows the thumb to grasp the device opposite the fingers resulting in a more efficient grip.

Figure 13:
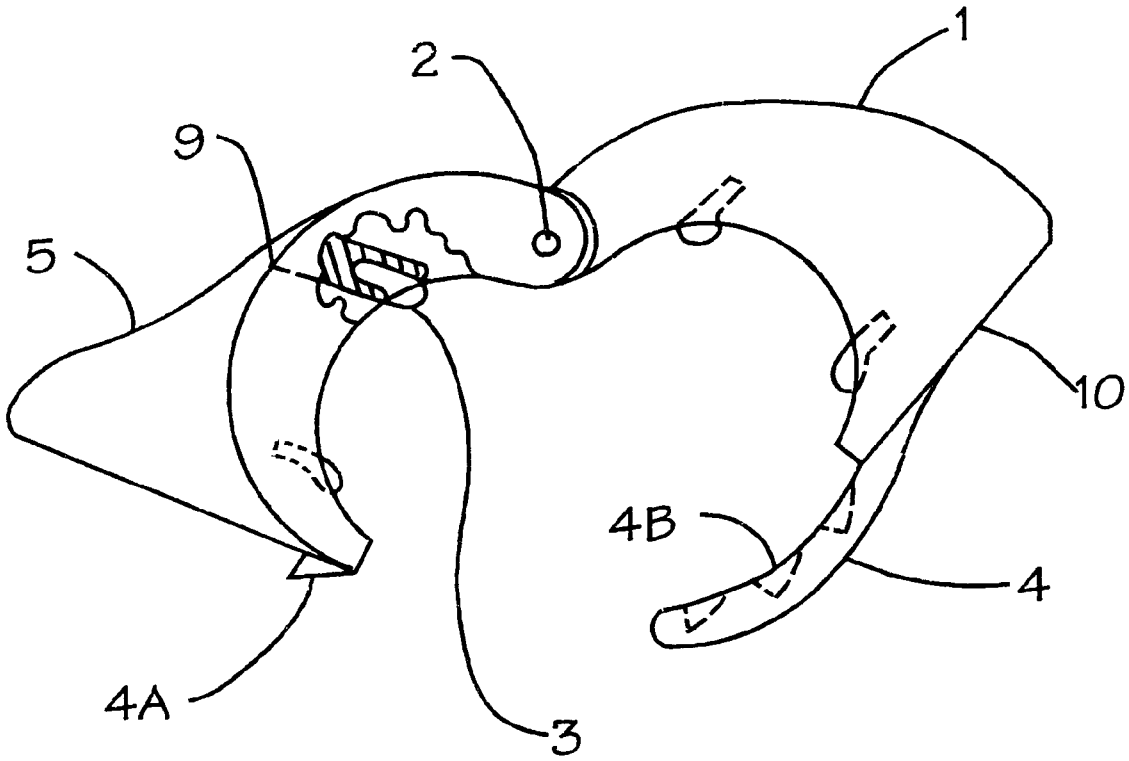
FIG. 13 shows the end view for the assembly of the device.

FIG. 13, end view of Hand at Rest Device, showing: how the finger half 1 and the palm half 9 are assembled by inserting hinge pin 2 into hole of each half; rubber pads 3 are pressed into rubber grooves 14; adjustable latch 4, using latch hook 4A and latch notches 4B, to mount the Hand at Rest Device onto shaft; palm heel 5 prevents the Hand at Rest Device from rotating in the hand and helps to keep the shaft approximately 90 degrees to the hand; and thumb surface area 10 allows the thumb to grasp the device opposite the fingers resulting in a more efficient grip.

Figure 14:
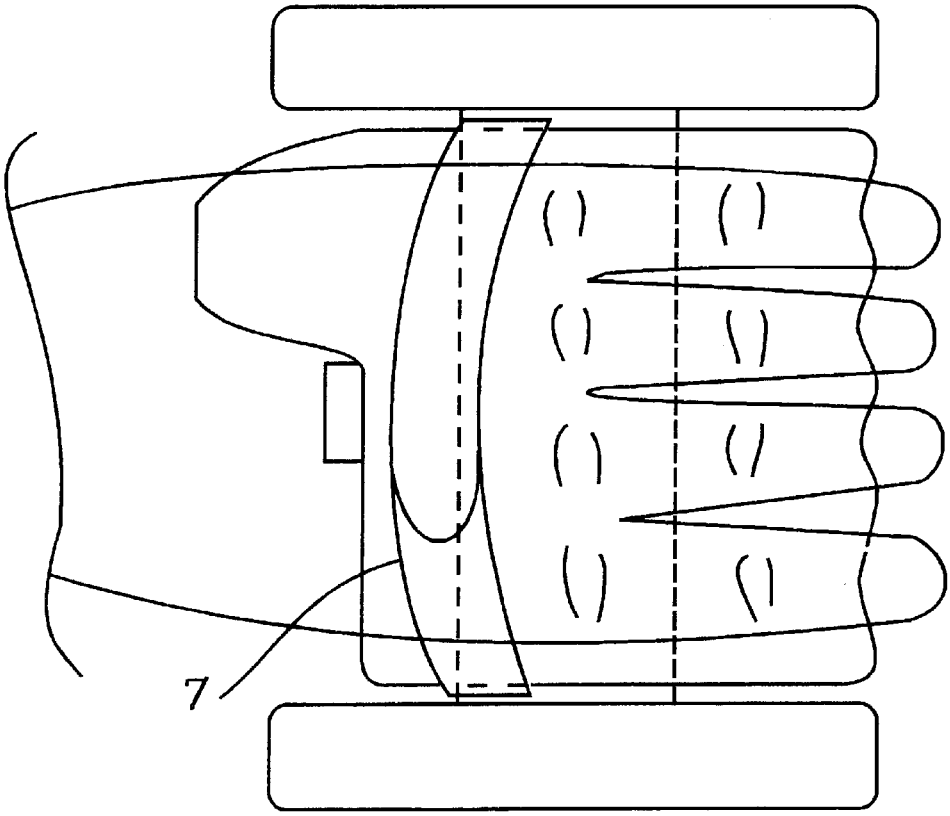
FIG. 14 shows the plane view of the Hand at Rest Device on a hand.

FIG. 14, plane view of Hand at Rest Device being held by user's hand and showing how adjustable strap 7 fits over the back of the hand.

Figure 15:
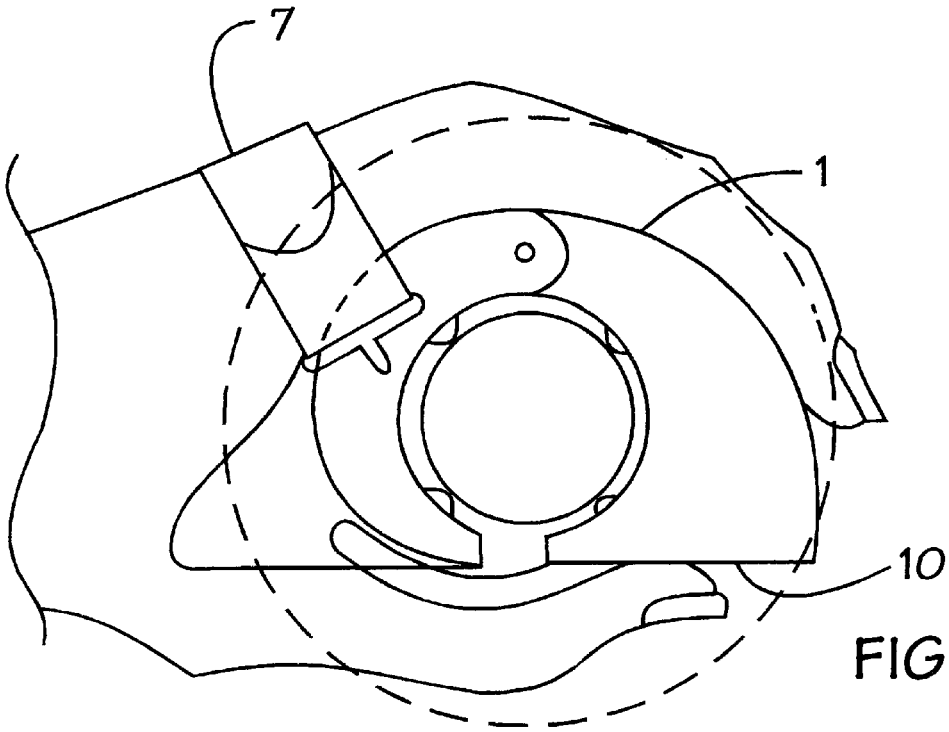
FIG. 15 shows the end view of the Hand at Rest Device on a hand.

FIG. 15, End view of Hand at Rest Device being held by user's hand and showing how the hand is placed with fingers on top of the Device and the thumb under the Hand at Rest Device and how the adjustable strap 7 fits over the back of the hand.

What is claimed is:

1. A hand at-rest grip device comprising:

a finger half, said finger half having an extended perimeter for supporting the fingers in an extended, at-rest position;

a palm half contoured to fit the palm of the hand, said palm half having a palm heel on one side for preventing the device from rotating in the hand and a thumb surface area on the other side for allowing the thumb to grasp the device opposite the fingers in an extended, at-rest position; and means for connecting said finger half and palm half around a handlebar.

2. The grip device of claim 1, further comprising finger grooves on the finger half.

3. The grip device of claim 1, further comprising an adjustable strap for distributing weight over the back of the hand.

4. The grip device of claim 1, further comprising an adjustable strap for distributing weight over the back of the fingers.

5. The grip device of claim 1, further comprising.

6. The grip device of claim 1, wherein said finger half and said palm half are hinged together at one side for attachment about a handlebar.

7. The grip device of claim 6, wherein the finger half and palm half are hinged together on their top sides.

8. The grip device of claim 6, further comprising a latch for securing the side opposite the hinge around the handlebar.

9. The grip device of claim 8, wherein said latch is adjustable to accommodate bars of varying diameter.

10. The grip device of claim 1, wherein said means includes a transverse aperture for accommodating a handlebar.

11. The grip device of claim 10, further comprising friction pads within said aperture for gripping the handlebar.

12. The grip device of claim 11, wherein said friction pads are compressible for accommodating bars of varying diameter.

13. The grip device of claim 12, wherein said friction pads are rubber.

* * * * *